US006004178A

United States Patent [19]

Liu et al.

[11] Patent Number: 6,004,178

[45] Date of Patent: Dec. 21, 1999

[54] LIFE SAVING DEVICE THAT CAN BE ATTACHED TO THE BODY OF A USER

[76] Inventors: Bong-Fu Liu; Kuo-Ming Chang, both of 5F-23, 70, Fu-Shing Road, Taoyuan, Taiwan

[21] Appl. No.: 09/097,566

[22] Filed: Jun. 15, 1998

[51] Int. Cl.[6] ..... B63C 9/105

[52] U.S. Cl. ..... 441/96; 441/88; 441/92

[58] Field of Search ..... 441/88, 92, 96, 441/106, 121, 122, 93, 94

[56] References Cited

U.S. PATENT DOCUMENTS

| | | | |
|---|---|---|---|
| 3,042,946 | 7/1962 | Davis et al. | 441/94 |
| 3,173,162 | 3/1965 | Elder, Jr. | 441/94 |
| 4,551,106 | 11/1985 | Prager | 441/94 |
| 4,810,219 | 3/1989 | Anderson et al. | 441/94 |
| 5,022,423 | 6/1991 | Britt | 137/68.1 |

FOREIGN PATENT DOCUMENTS

| | | | |
|---|---|---|---|
| 979819 | 1/1965 | United Kingdom | 441/93 |

*Primary Examiner*—Sherman Basinger

[57] ABSTRACT

A life saving device that can be attached to the body of a user including an attachment strap, a housing, an inflation sac, a rope, a pressure release device and a compressed air cylinder. The attachment strap is attached to the user's body. The housing accommodates the inflation sac, the rope, the pressure release device and the compressed air cylinder. An upper cover of the housing is popped off when the inflation sac is being inflated. The inflation sac envelops the compressed air cylinder and most of the pressure release device with a press element of the latter partly projecting from an opening of the inflation sac. When the press element is pressed, a steel ball stopping the compressed air cylinder is pushed away so that compressed air escapes from the cylinder through a tubular body and an air outlet of the pressure release device into the interior of the inflation sac to form a life ring. The rope is provided to allow the user to pull back the inflation sac if it floats away from him/her.

2 Claims, 6 Drawing Sheets

LIFE SAVING DEVICE THAT CAN BE ATTACHED TO THE BODY OF A USER

BACKGROUND OF THE INVENTION

The present invention relates generally to a life saving device that can be attached to the body of the user, and more particularly to a life saving device that is small and can be carried on the user's body and easily operated to become inflated to form a life ring during emergencies.

For those who are not good at swimming but like to play or angle at the seaside, it will be dangerous if the waves suddenly big. It is therefore desirable to provide a compact life saving device that can be attached to the user's body and can be quickly inflated to keep the user from being drowned.

SUMMARY OF THE INVENTION

A primary object of the present invention is to provide a life saving device that can be attached to the user's body and can be speedily inflated during emergency.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
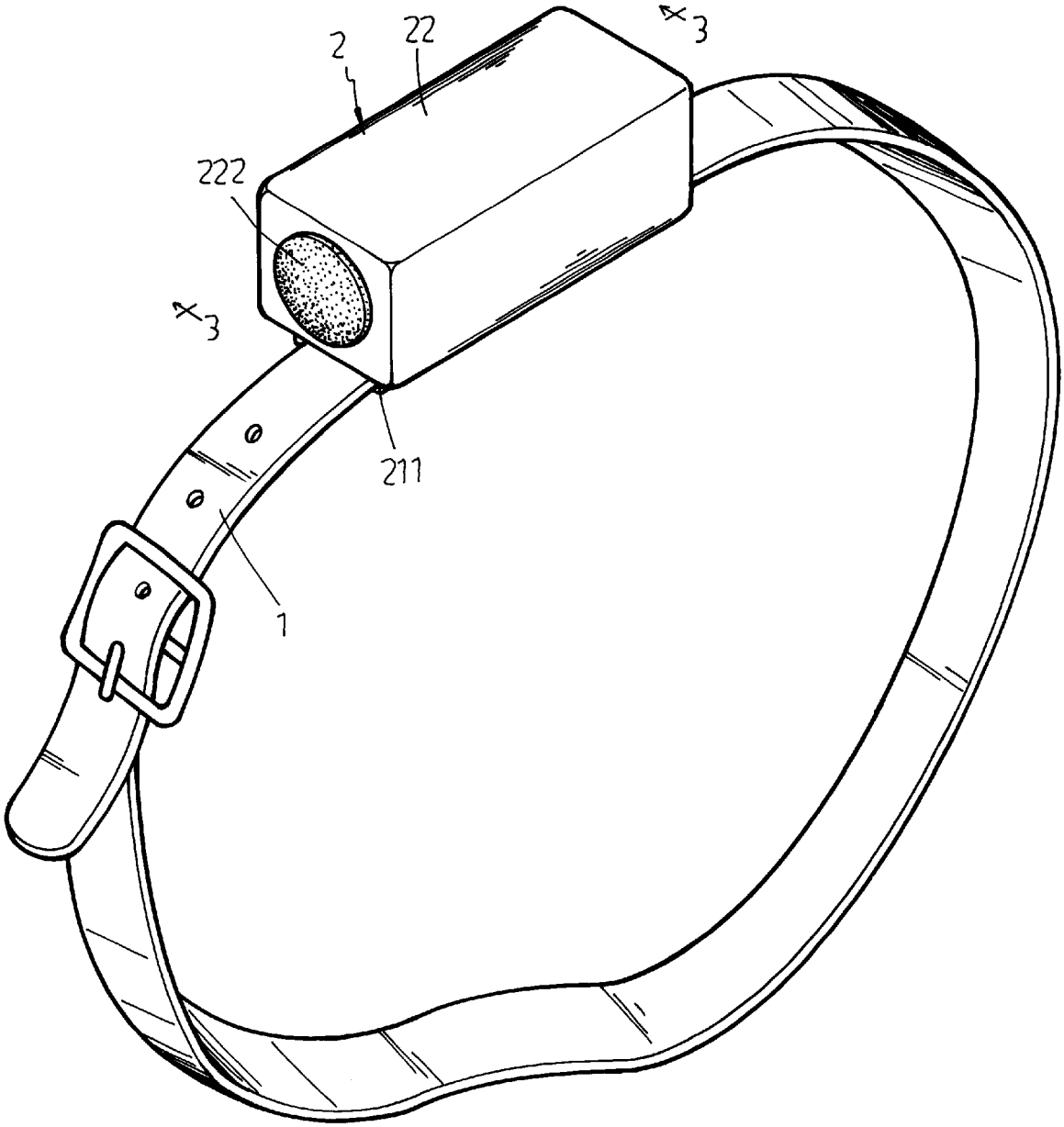
FIG. 1 is a perspective view of the present invention.
Figure 2:
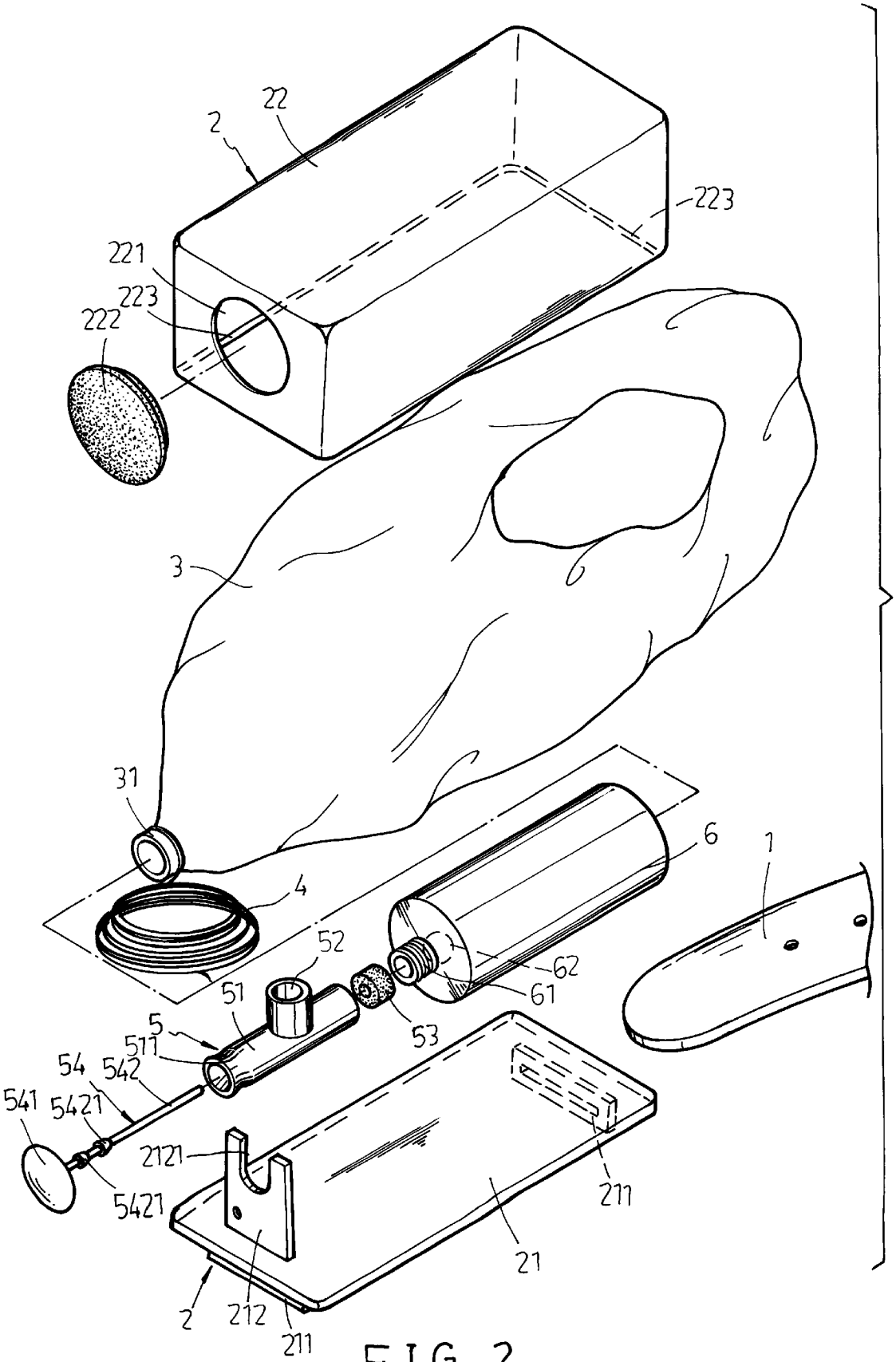
FIG. 2 is a perspective exploded view of the present invention.
Figure 3:
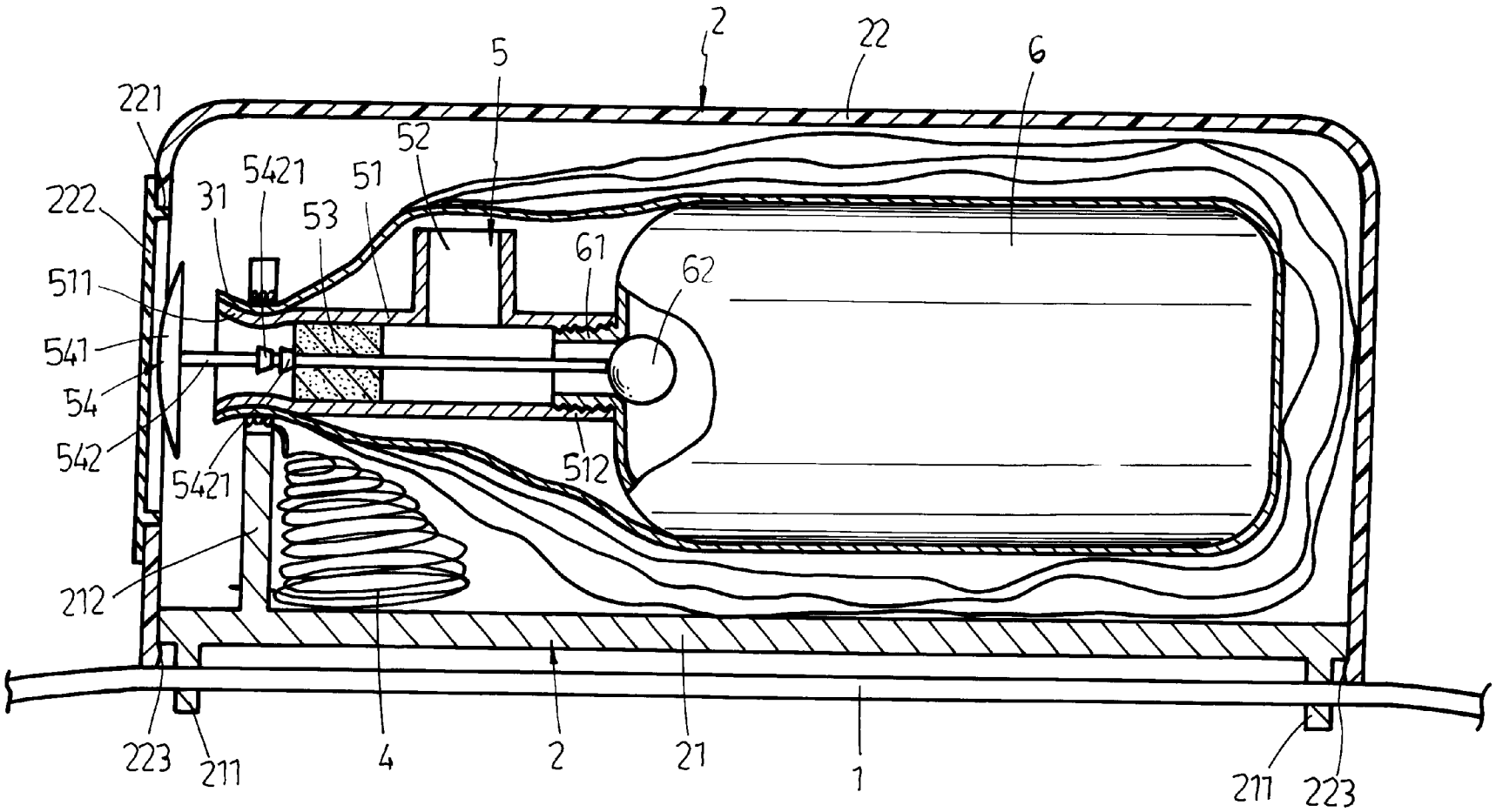
FIG. 3 is a sectional view taken along line 3—3 of FIG. 1 along the direction of the arrows.

Referring to FIGS. 1–4, the life saving device according to the present invention is shown to comprise an attaching strap 1, a housing 2, an inflation sac 3, a rope 4, a pressure release device 5 and a compressed air cylinder 6.

The attaching strap 1 is provided to attach to the body of the user. For instance, it may be configured to be a belt worn on the user's waist or a shorter band tied around the user's arm.

The housing 2 is provided to connect to the attaching strap 1 and receive the inflation sac 3, the rope 4, the pressure release device 5 and the compressed air cylinder 6. The housing 2 includes a base 21 and an upper cover 22. The base 21 is provided with a suspension portion 211 and a frame 212. The suspension portion 211 allows passage of the attaching strap 1 therethrough so that the base 21 may be suspended on the attaching strap 1. The frame 212 is provided with a U-shaped indentation 2121. The upper cover 22 is provided with a hook portion 223 along its bottom edges to engage slightly the base 21 such that it may disengage from the base 21 when subjected to a slightly large external force. In addition, the upper cover 22 is provided with a hole 221 on one end surface, an elastic press piece 222 being installed on the hole 221.

The inflation sac 3 has an interior enclosing the compressed air cylinder 6 and most of the pressure release device 5, and an opening 31 capable of sealing and securely connected to a diameter-reduced portion 511 of a tubular body 51 of the pressure release device 5 so that a press element 54 of the pressure release device 5 is partly exposed on the outside (the structure of the pressure release device 5 being discussed in detail hereinafter). Furthermore, the opening 31 of the inflation sac 3 together with the diameter-reduced portion 511 of the pressure release device 5 is placed in the indentation 2121 of the frame 212 so that the pressure release device 5, the compressed air cylinder 6, and the inflation sac 3, after being folded, may be positioned and squeezed in the interior space of the housing 2. When the press element 54 of the pressure release device 5 is being pressed, the pressure release device 5 may be prevented from moving inwardly. Additionally, when the inflation sac 3 is inflated, it is in the shape of a life ring, and during the early stage of inflation, the upper cover 22 of the housing 2 may be popped off (see FIG. 5).

Figure 6:
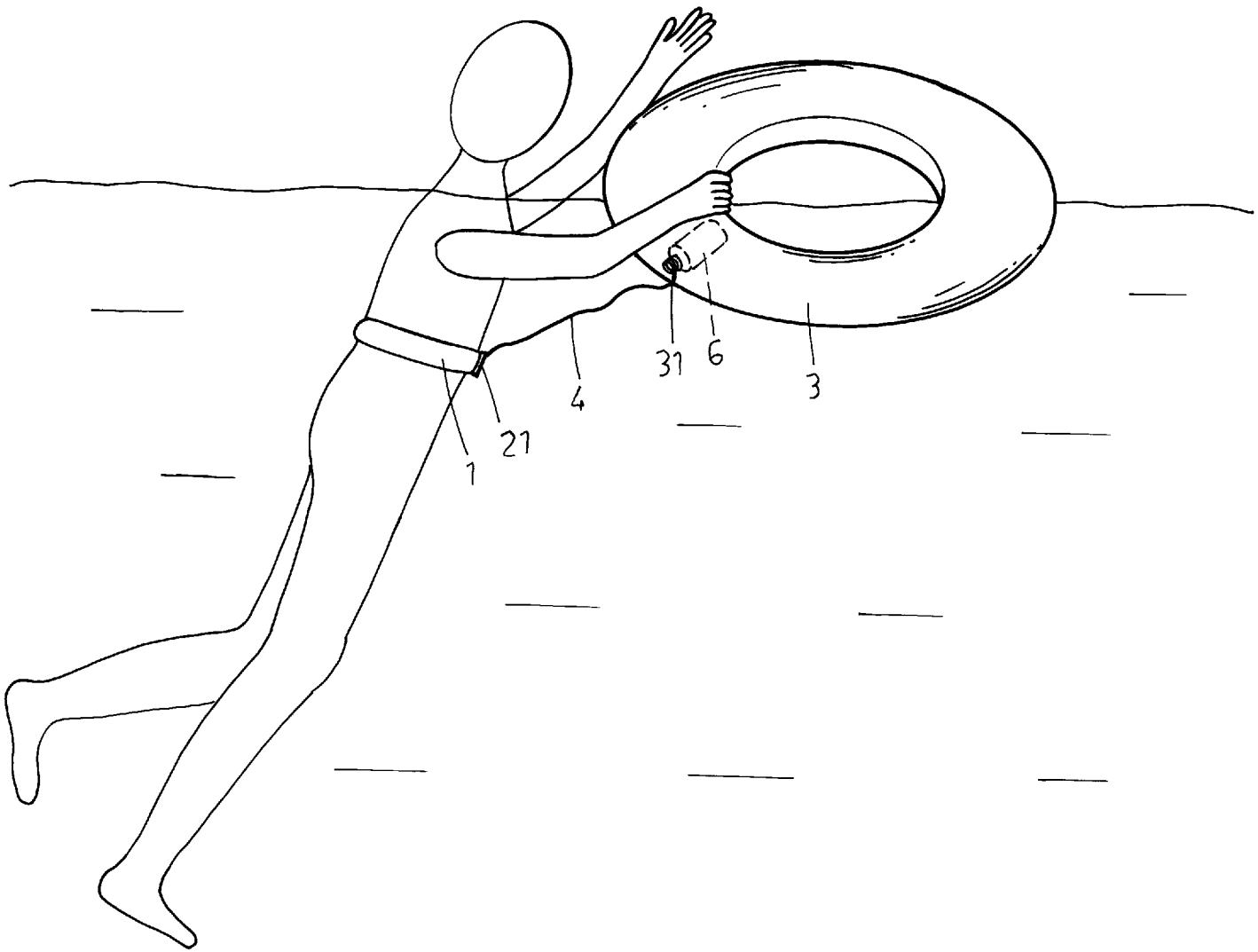
FIG. 6 is a schematic view illustrating use of the present invention during emergencies.

The rope 4 has one end connected to the outside of the opening 31 of the inflation sac 3, with the other end secured to the base 21 of the housing 2 so that, after inflation of the inflation sac 3, the user may easily pull back the inflation sac 3 for subsequent use (see FIG. 6).

The pressure release device 5 includes the tubular body 51, an air outlet 52, a stopper 53, and the press element 54. The tubular body 51 has the diameter-reduced portion 511 on an outer end thereof to seal and be secured to the opening 31 of the inflation sac 3 so that they can be together positioned on the frame 212 of the housing 2. Additionally, an inner end of the tubular body 51 has a threaded portion 512 for engaging a threaded end 61 of the compressed air cylinder 6. The air outlet is provided on one side of the tubular body 51 and communicates therewith so that when air is released from the compressed air cylinder 6, it may flow via the tubular body 51 and exit through the air outlet 52 to the interior of the inflation sac 3. The stopper 53 is tightly fitted in the interior of the tubular body 51 and is centrally provided with a through hole for passage of a rod 542 of the press element 54 therethrough. When the compressed air cylinder 6 releases air, the stopper 53 is shielded by the diameter-reduced portion 511 of the tubular body 51 so that it will not be pushed to the outside. The press element 54 includes a pressure bearing portion 541 and the above-mentioned rod 542. The pressure bearing portion 541 projects from the outside of the tubular body 51 and adjacent to the elastic press piece 222 of the housing 2. The rod 542 passes through the center of the tubular body 51 and the stopper 53. Before it displaces inwardly, its inner end is near or in contact with a steel ball 62 (see FIG. 3) of the compressed air cylinder 6. In use, the rod 542 displaces inwardly to push the steel ball 62 from its position (see FIG. 4) so that air inside the compressed air cylinder 6 escapes from the opening at the threaded end 61 to the outside. Furthermore, in order to prevent the press element 54 itself from being pushed reversely by the compressed air, the rod 542 is provided with hooking rings 5421 thereon so that, after it has been pressed into the hole of the stopper 53, it is firmly retained by the stopper 53 in a single direction and will not displace in a reverse direction.

After being filled with compressed air, the compressed air cylinder 6 utilizes the steel ball 62 to stop the inner opening of the threaded end 61 so that air will not leak. The threaded end 61, on the other hand, is fastened to the threaded portion 512 of the tubular body 51.

Figure 4:
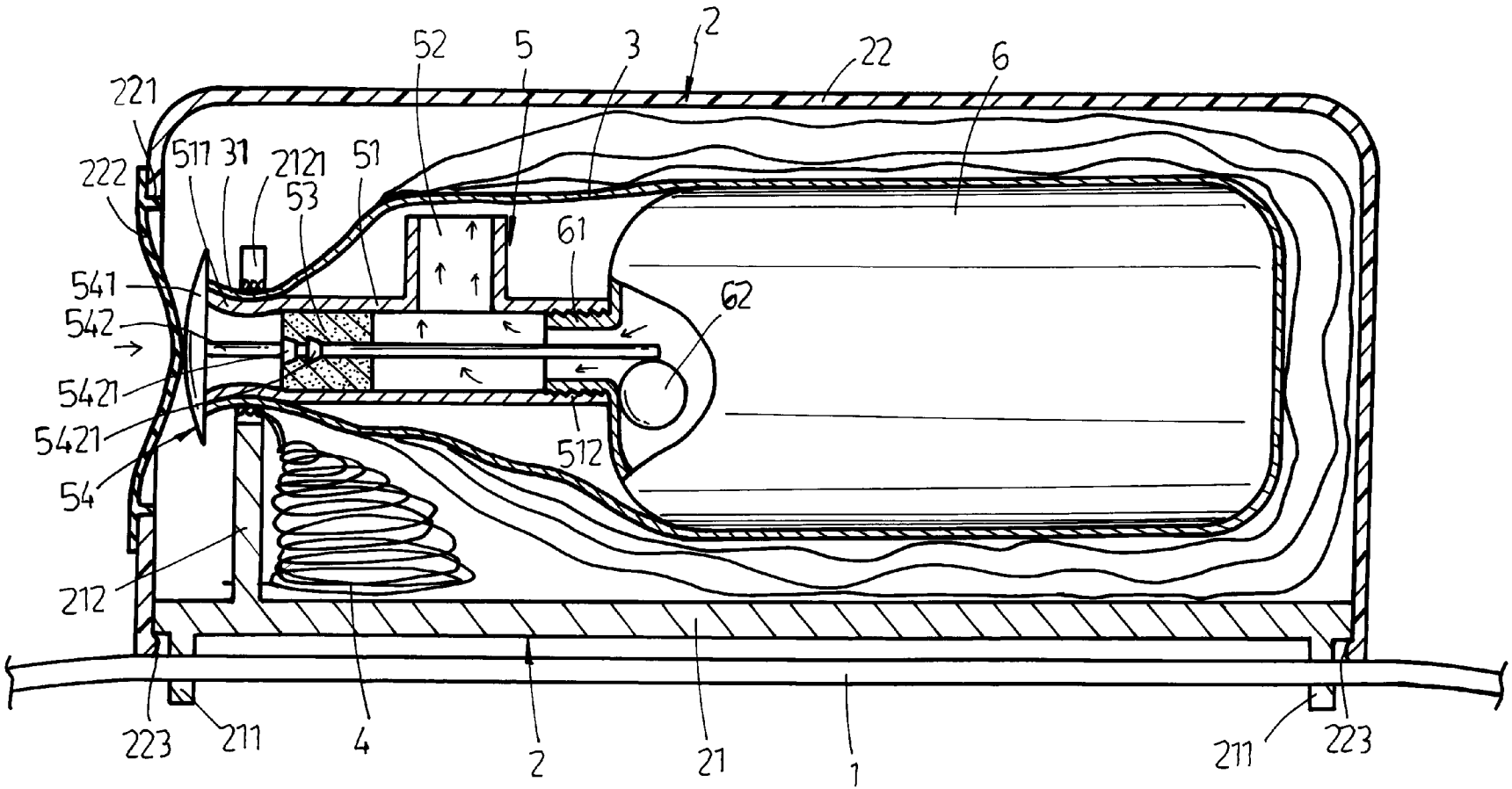
FIG. 4 is a sectional view of the present invention after an elastic press piece has been pressed.

Referring to FIG. 4, when the user is in danger of being drowned, he/she may press the elastic press piece 22 on the housing 2 inwardly. The elastic press piece 222 will then push the pressure bearing portion 541 of the press element 54 so that the rod 542 displaces inwardly to push away the steel ball 62 of the compressed air cylinder 6 to release compressed air therein. Since the press element 54 and the stopper 53 are prevented from reverse displacement, the steel ball 62 will not block the inner opening of the threaded end 61 and the stopper 53 will not be pushed to the outside. At this point, the compressed air from the compressed air cylinder 6 will flow via the tubular body 51 to the air outlet 52 into the interior of the inflation sac 3.

Figure 5:
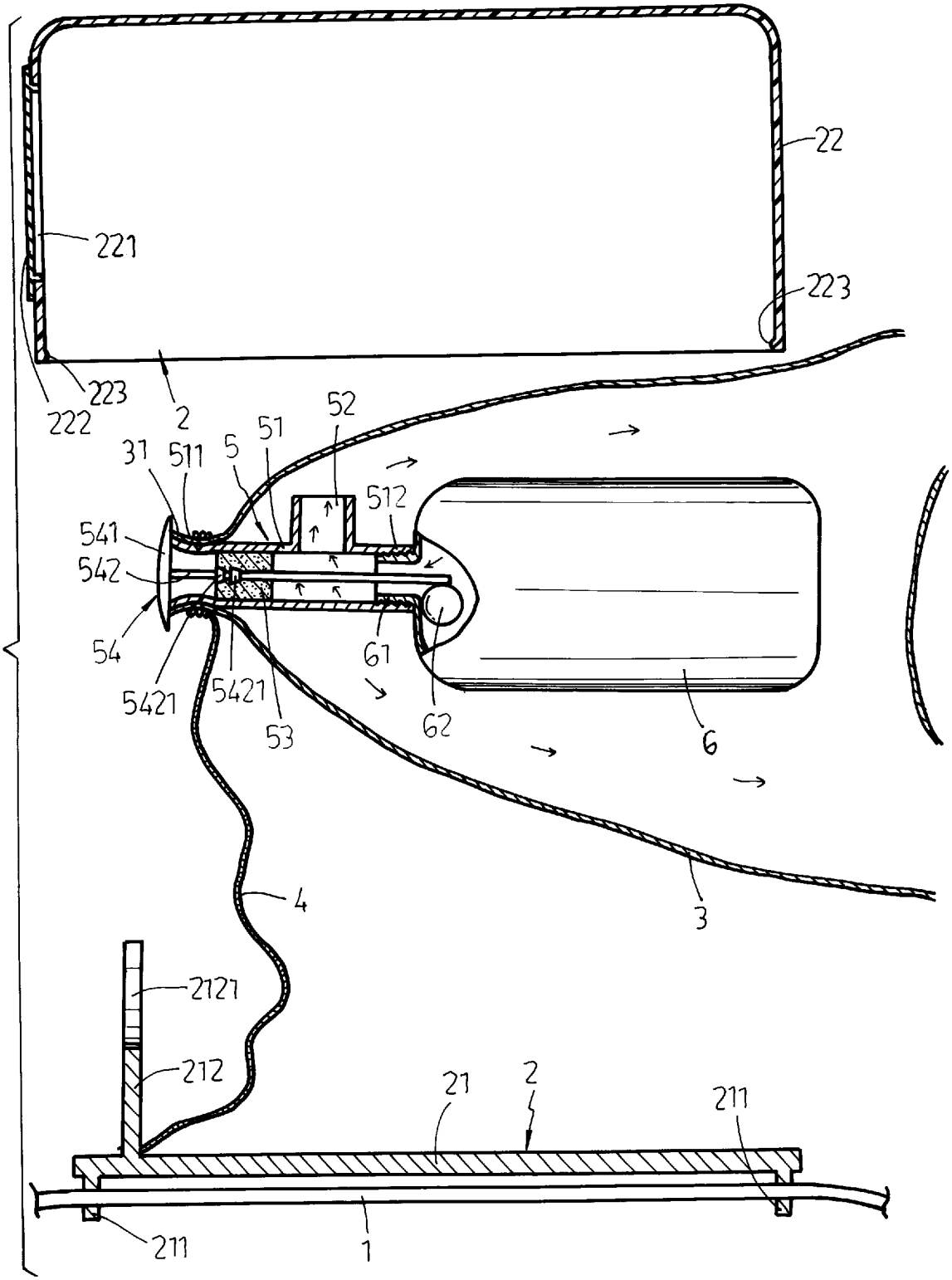
FIG. 5 is a sectional schematic view of the present invention showing an air sac at an initial stage of inflation and an upper cover is popped out.

Referring to FIG. 5, when the inflation sac 3 is being inflated, the upper cover 22 of the housing 2 will be popped out, and the inflation sac 3 will continue to expand until it floats on the water.

Referring to FIG. 6, the inflation sac 3 will become inflated in a short while and forms a life-ring structure. The user may then grab the inflation sac 3. If the inflation sac 3 is floating away, the user may pull the rope 4 to pull back the inflation sac 3.

Although the present invention has been illustrated and described with reference to the preferred embodiment thereof, it should be understood that it is in no way limited to the details of such embodiment but is capable of numerous modifications within the scope of the appended claims.

What is claimed is:

1. A life saving device that can be attached to the body of a user, comprising:

an attachment strap adapted to be attached to the user's body;

a housing including a base and an upper cover, said base being connected to the attachment strap, said upper cover being loosely fastened to said base such that they disengage from each other when a slightly large external force is applied thereto, said upper cover being provided with an elastic press piece on one end surface thereof;

a compressed air cylinder including a threaded end and a steel ball which stops an inner opening of said threaded end after said compressed air cylinder is filled with compressed air;

a pressure release device connected to an outer portion of said threaded end of said compressed air cylinder and including a tubular body, an air outlet, a stopper and a press element, said air outlet being provided on one side of said tubular body and communicating therewith, said stopper being placed in an interior of said tubular body, said press element having a rod passing through said tubular body and the center of said stopper, said rod capable of pressing said steel ball of said compressed air cylinder downwardly when displacing inwardly, said press element further having a pressure bearing portion located near said elastic press piece of said housing;

an inflation sac having a life-ring shape after being inflated, said inflation sac having an opening and an interior accommodating therein said compressed air cylinder and most of said pressure release device with said press element partly exposed on the outside of said opening, said inflation sac being foldable and being housed in said housing together with said pressure release device and said compressed air cylinder; and a rope connected between said inflation sac and said base of said housing;

whereby when said elastic press piece of said housing is being pressed inwardly, said press element of said pressure release device is caused to displace inwardly to push away said steel ball of said compressed air cylinder so that compressed air is released from said compressed air cylinder and flow through said tubular body and said air outlet into the interior of said inflation sac, said upper cover of said housing being popped off during inflation of said inflation sac, thus forming a life saving ring, said rope being provided to allow the user to pull said inflation sac back to him/her if said inflation sac is floating away.

2. A life saving device that can be attached to the body of a user as defined in claim 1, wherein said tubular body of said pressure release device includes a diameter-reduced portion, and said base of said housing is provided with a frame, said frame having an indentation, said opening of said inflation sac being sealed and secured to said diameter-reduced portion and being placed in said indentation of said frame together with said diameter-reduced portion for positioning purposes and for preventing said pressure release device from displacing inwardly when said press element is subjected to an external force.

* * * * *